United States Patent [19]

Schmidt et al.

[11] Patent Number: 4,892,222

[45] Date of Patent: Jan. 9, 1990

[54] PORT ASSEMBLY FOR A CONTAINER

[75] Inventors: Josef Schmidt, Libertyville; James Ducay, Grayslake, both of Ill.; Hugh Forman, Waukesha, Wis.

[73] Assignee: Baxter International Inc., Deerfield, Ill.

[21] Appl. No.: 276,274

[22] Filed: Nov. 25, 1988

[51] Int. Cl.[4] ..... A61J 1/00

[52] U.S. Cl. ..... 220/356; 215/247; 604/415

[58] Field of Search ..... 220/356, 306, 307; 215/DIG. 3, 247, 248, 249; 604/415

[56] References Cited

U.S. PATENT DOCUMENTS

| | | | |
|---|---|---|---|
| 2,907,489 | 10/1959 | Taylor, III | 220/27 |
| 3,030,955 | 4/1962 | Gossett et al. | 128/272 |
| 3,105,613 | 10/1963 | Barton et al. | 604/415 X |
| 3,244,308 | 4/1966 | Esposito, Jr. | 215/270 |
| 3,805,986 | 4/1974 | Gaudin | 215/31 |
| 3,900,028 | 8/1975 | McPhee | 604/415 |
| 3,920,141 | 11/1975 | Bojardi | 215/251 |
| 4,180,173 | 12/1979 | Diaz | 215/6 |
| 4,219,912 | 9/1980 | Adams | 215/247 X |
| 4,294,249 | 10/1981 | Sheehan et al. | 215/247 X |
| 4,303,067 | 12/1981 | Connolly et al. | 128/272 |
| 4,393,909 | 7/1983 | Pearson | 150/8 |
| 4,412,573 | 11/1983 | Zdeb | 215/247 X |
| 4,479,989 | 10/1984 | Mahal | 604/415 X |
| 4,482,070 | 11/1984 | Dubach | 215/253 |
| 4,484,916 | 11/1984 | McPhee | 604/256 |
| 4,632,267 | 12/1986 | Fowles et al. | 215/253 |

FOREIGN PATENT DOCUMENTS

| | | |
|---|---|---|
| 86/02906 | 5/1986 | PCT Int'l Appl. . |
| 86/02907 | 5/1986 | PCT Int'l Appl. . |

*Primary Examiner*—Steven M. Pollard

*Attorney, Agent, or Firm*—P. E. Schaafsma; R. M. Barrett; P. C. Flattery

[57] ABSTRACT

A port assembly for a container is provided. The port assembly includes an elongated tube extending from an end of a base, the tube defining a tubular bore for receiving a member for accessing the container. The tubular bore includes a membrane for separating the tubular bore into a first portion and second portion, the first portion being closer to the container than the second portion. A resealing injection site is mechanically locked within the second portion of the channel. A method for making the port assembly is also provided.

14 Claims, 1 Drawing Sheet

PORT ASSEMBLY FOR A CONTAINER

BACKGROUND OF THE INVENTION

The present invention relates generally to a port and closure assembly for a container. More specifically, the present invention relates to the port assembly that is used to access a container that houses a liquid.

Ports are utilized to access material packaged within a container. As used herein, the term "ports" includes, without limitation, fitments, valves, and other means for accessing a container. In the medical industry, parenteral and peritoneal dialysis solutions are packaged in flexible containers that are accessed via a port. An example of such a flexible container is the VIAFLEX collapsible plastic container sold by Baxter Healthcare Corporation of Deerfield, Illinois.

The port can function not only to provide means for accessing the solution contained within the container, but also can provide a site for the injection of material into the solution container. For example, it may be desirable to inject a medicament into a dextrose or saline solution, and then administer the resultant product intravenously into a patient. Such an injection site, however, must be so constructed that it is resealing so that contamination of the resultant product is prevented and the resultant product does not leak out the injection port.

Typically, the port assembly comprises a tubular structure having an inner bore, that extends from a base that is secured to the container. Located within the bore, typically, is a needle pierceable wall that provides a barrier between the fluid contained within the container and the outside environment. Usually, pointed means that pierce the pierceable wall, are used to gain access to the container and thereby the fluid housed therein. To guard against contamination at the port, closures are typically utilized for covering the opening of the port.

Although port assemblies having injection sites are known, these port assemblies have not been entirely satisfactory. Some of the problems of prior port assemblies relate to the manufacturing process and the failure of the injection site to be sufficiently secured within the port of the port assembly.

There is therefore a need for an improved port assembly having an injection site.

SUMMARY OF THE INVENTION

The present invention provides an improved port assembly for a container. To this end, the port includes an elongated tube extending from an end of a base that is secured to a container. The tube defines a tubular bore for receiving means for accessing the container, such as via a hypodermic needle or like, and includes a pierceable membrane for separating the tubular bore into a first portion and a second portion. The first portion is closer to the container than the second portion. A resealing injection site is positioned within the bore, defined by the elongated tube, in the second portion thereof. The elongated tube includes means for mechanically locking the resealing injection site within the second portion of the tubular bore.

In an embodiment of the present invention, the means for mechanically locking the resealing injection site includes a flange that circumscribes a portion of the resealing injection site.

In an embodiment of the present invention, the means for mechanically locking is defined, in part, by a portion of the elongated tube that is ultrasonically "swaged over", causing the portion of the tube to define a flange that circumscribes a portion of the resealing injection site.

In an embodiment of the present invention, the means for mechanically locking the resealing injection site includes a ring-shaped member extending from the pierceable membrane into the second portion of the bore.

In an embodiment of the present invention, the port assembly includes a base, an injection port, and an administration port. The injection port includes a pierceable membrane and a resealable injection site located within an upper portion of a tube that extends from the base and forms a portion of the injection port. The administration port provides means for allowing the fluid contained within the container to be administered to a patient via, for example, an administration set.

The present invention also provides a method for producing a port assembly for a container comprising the steps of: molding a port structure having a base and an elongated tube extending from the base; and mechanically locking within a tubular bore defined by the tube a resealing injection site.

In an embodiment of the method of the present invention, a pierceable membrane is created within the tubular bore to define an upper bore and a lower bore. In an embodiment of the method of the present invention, the resealing injection site is mechanically locked within the upper bore.

In an embodiment of the method of the present invention, the method includes the step of ultrasonically swaging over the elongated tube to mechanically lock the resealing injection site within the bore. In a further embodiment of the method of the present invention, the method includes the step of causing a portion of the elongated tube to overlap a portion of the resealing injection site to mechanically lock the resealing injection site in the tubular bore.

An advantage of the present invention is that it provides an improved port assembly for a container.

A further advantage of the present invention is that it provides an improved injection site for a container.

Another advantage of the present invention is that it provides an improved means for securing a resealing injection site within a tubular bore of a port.

A still further advantage of the present invention is that it provides an improved closure assembly having an injection port and an administration port.

Furthermore, an advantage of the present invention is that it provides an improved method for making a closure assembly for a container.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an improved port assembly for a container. As previously stated, the port provides a means for accessing the container. To this end, the port can provide a means for injecting into the container a substance or withdrawing therefrom the contents of the container. The container can be any known in the art. However, the present invention is particularly directed to use with a container for housing solutions for use in the medical industry, these fluids should be maintained and extracted under sterile conditions.

Figure 1:
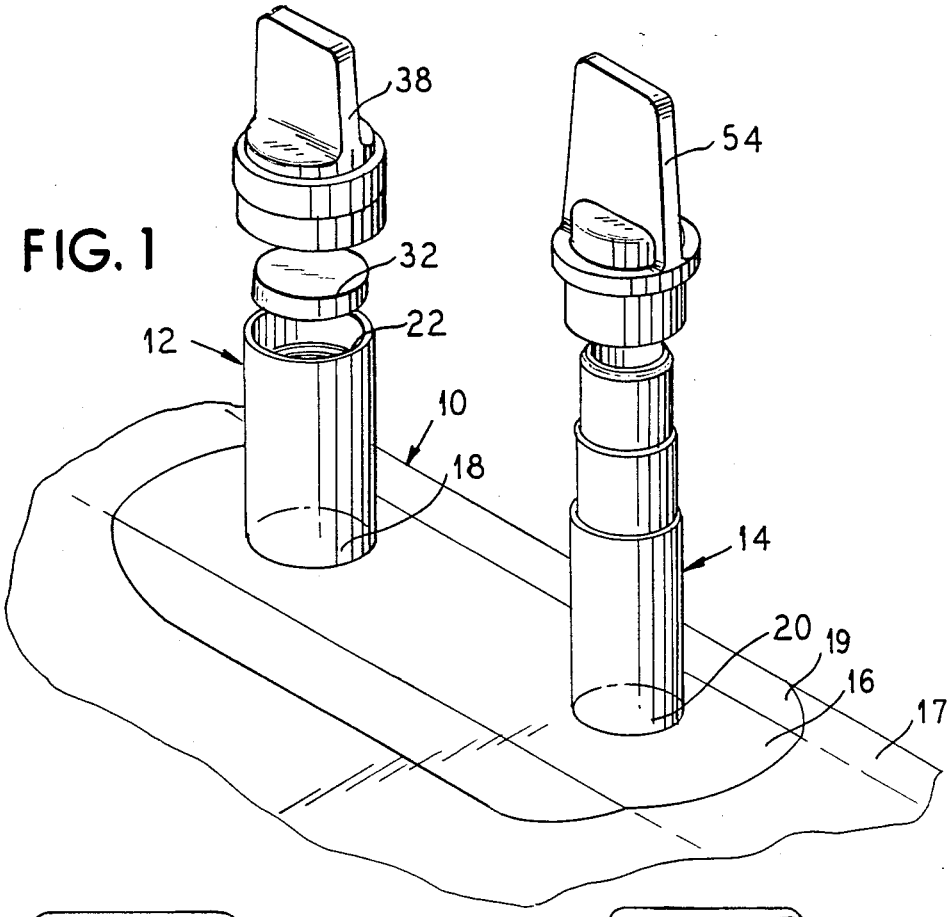
FIG. 1 illustrates an exploded perspective view of an embodiment of the port assembly of the present invention.

Referring to FIG. 1, the port assembly 10 of the present invention is illustrated. As illustrated, the port assembly 10 includes an injection port 12, an administration port 14, and a base 16. Preferably, the base 16 of the port assembly 10 is secured to a container 17, such as a flexible bag. In the embodiment of the invention illustrated, the base 10 is not planar, but instead includes curved portions 19, to improve delivery of the product housed in the container to the ports.

The injection port 12 and administration port 14 extend from the base 16 and include openings 18, and 20, respectively, that allow the injection port and administration port to be in fluid communication with the contents of the container. Although, in the embodiment of the invention illustrated in FIG. 1, the port assembly 10 includes an injection port 12 and an administration port 14, the port assembly 10 of the present invention can include more or less port members.

Preferably, the injection port 12 functions as a means for injecting into the container 17, to which the port assembly 10 is secured, a substance, such as a drug, that is to be diluted with the contents of the container 17. Preferably, the administration port 14 functions to provide a means for accessing the contents of the container. To this end, the administration port 14 is so constructed and arranged that it can receive a spike portion of an administration site, that allows the contents of the container 17 to be, for example, intravenously administered to a patient.

Figure 2:
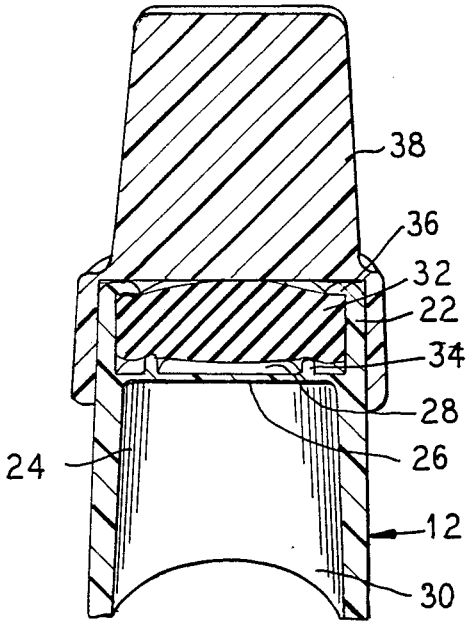
FIG. 2 illustrates a cross-sectional view of the injection port of the port assembly of FIG. 1.

Referring now to FIG. 2, the injection port 12 is illustrated. The injection port 12 includes a tubular wall 22 that defines therein a tubular bore 24. Located within the tubular bore 24 is a pierceable membrane 26. The pierceable membrane 26 divides the tubular bore 24 into an upper portion 28 and a lower portion 30.

Located within the upper portion 28 of the tubular bore 24 is a resealing injection site 32. The resealing injection site 32 allows the injection of a substance, for example a drug, through the injection port 12 into the container 17 to which the port assembly 10 is sealed. Because the injection site 32 is resealing, the injection site 32 functions to provide a seal after the injection of the drug into the container 17. This has two functions: (1) to prevent microbial ingress into the container 17 through the injection port 12; and (2) to prevent leakage of the resultant product contained in the container 17, through the injection port 12. To provide a resealing construction, preferably, the injection site 32 is constructed from natural rubber.

The injection port 12, and more specifically, the tubular wall 22, provides a mechanical lock for securing the resealing injection site 32 within the injection port 12. To this end, the injection port 12 includes a circular or ring-shaped flange 34 that extends outwardly from the pierceable membrane 26. The resealing injection site 32 rests upon the flange 34. To lock the resealing injection site 32 into place, the flange 34 cooperates with a portion 36 of the tubular wall 22 that is bent over and defines a circular flange that circumscribes, or overlaps, a portion of the resealing injection site 32. The portion 36 of the tubular wall and flange 34 function to lock the resealing injection site 32 within the injection port 12.

A preferred method of locking the injection site 32 in position is as follows. First, the injection port 12, and specifically, the tubular wall 22. is constructed. The injection site 32 is then inserted within the upper portion 28 of the tubular bore 24. The injection port 12 is then ultrasonically welded so that the portion 36 of the tubular wall 22 is caused to be bent around and circumscribe the injection site 32. To this end, during the ultrasonic welding of the tubular wall 22, a force is applied to a top portion of the tubular wall 22 causing the top portion to be forced inwardly. This functions to seal and lock the resealing injection site 32 within the upper portion 28 of the injection port 12. It should be noted, however, that any means of swaging over the portion 36 of the tubular wall 22 can be used. For example, the portion 36 can also be swaged over by cold forming or hot forming.

Preferably, the tubular wall 22, as well as remaining portions of the port assembly 10, is constructed from polypropylene. Most preferably, the port assembly 10 is constructed from a rubber modified polypropylene, such as a Kraton modified polypropylene.

In order to provide a sterile injection port 12, the injection port is preferably covered by a removable closure 38. The closure 38 can be any known in the art. Preferably, the closure 38 is a closure such as that set forth in U.S. patent application Ser. No. 276,273, entitled: "Closure and Port" Assembly, and filed herewith in the names of the inventors of this present patent application.

Figure 3:
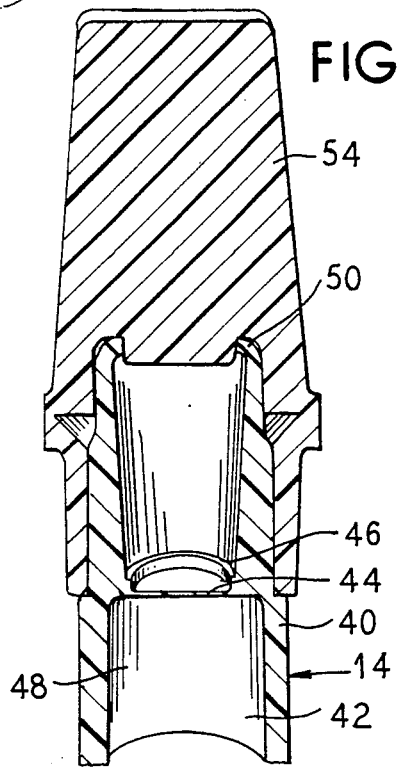
FIG. 3 illustrates a cross-sectional view of the administration port of the port assembly of FIG. 1.

Referring now to FIG. 3, the administration port 14 is illustrated. As illustrated, the administration port 14 includes a tubular wall 40 that defines a tubular bore 42. Located within the tubular bore 42 is a pierceable membrane 44. The pierceable membrane 44 divides the tubular bore 42 into an upper portion 46 and a lower portion 48.

The administration port 14 has a construction so that it is adaptable for receiving an administration set. To provide a secure seal with such a set, in the embodiment of the invention illustrated, a top portion 50 of the tubular wall 40 is tapered. Similar to the injection port 12, to provide a sterile administration port 14, the port can be covered by a removable closure 54.

In constructing the embodiment of the port assembly 10 of the present invention illustrated, the injection port 12, administration port 14, and base 16 are integrally constructed. The resealing injection site 32 is then positioned inside the bore 28 of the injection port 12. The injection site 32 is then mechanically locked in place. Closures 38 and 54, respectively, are then positioned over the injection port 12 and administration port 14. The port assembly can then be secured to a container 17.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

We claim:

1. A port for a container comprising:

an elongated tube extending from a base, the tube defining a tubular bore for receiving means for accessing the container, the tubular bore including a membrane for separating the tubular bore into a first portion and a second portion, the first portion being closer to the container than the second portion, the membrane including a ring extending from the membrane into the second portion of the tubular bore; and a resealing injection site, the elongated tube including a flange that circumscribes a portion of the resealable injection site to lock the resealable injection site against the ring in the second portion of the tubular bore.

2. The port of claim 1 wherein the resealing injection site is constructed from natural rubber.

3. The port of claim 1 wherein the flange is formed by swaging a portion of the elongated tube over the resealing injection site.

4. The port of claim 3 wherein the portion of the elongated tube is swaged over by ultrasonically welding the port and exerting a pressure on a top portion of the elongated tube.

5. The port of claim 1 wherein the resealing injection site has a circular cross-sectional shape.

6. The port of claim 1 including a closure for covering at least an opening of the port.

7. A port assembly for a container comprising:

a base;

an injection port, the injection port including a tubular structure extending from the base, the tubular structure defining a tubular bore therein, the tubular bore being divided into a lower and an upper portion by a pierceable membrane, the pierceable membrane including an annular rib extending into the upper portion of the tubular bore, the upper portion terminating at an opening of the injection port that is so constructed and arranged that it can receive means for accessing the container, the injection port including a resealing injection site, the tubular structure including a flange that circumscribes a portion of the resealable injection site to lock the resealing injection site within the upper portion of the tubular structure against the annular rib; and an administration port, secured to the base.

8. The port assembly of claim 7 including two closures, a first closure covering at least a portion of the injection port and the second closure covering at least a portion of the administration port.

9. The port assembly of claim 7 wherein the resealing injection site is constructed from natural rubber.

10. The port assembly of claim 7 wherein the base is not planar at all portions.

11. The port assembly of claim 7 wherein the administration port includes a tubular structure extending from the base that defines a tubular bore.

12. The port assembly of claim 11 wherein the administration port is so constructed and arranged that it interfaces with an administration set for accessing and delivering the contents of the container.

13. A method for producing a port assembly for a container comprising the steps of:

molding a port structure having a base and a tubular structure extending from the base;

defining an upper bore and a lower bore within the tubular structure by providing a pierceable membrane within the tubular structure having a ring extending into the upper bore; and providing a flange from the tubular structure to mechanically lock within the upper bore against the ring a resealing injection site.

14. The method of claim 13 wherein the step of providing a flange includes the step of ultrasonically welding a portion of the tubular structure to mechanically lock the resealing injection site within the upper tubular bore.

* * * * *